US007845722B1

(12) United States Patent
Manenti et al.

(10) Patent No.: US 7,845,722 B1
(45) Date of Patent: Dec. 7, 2010

(54) INFANT SEAT BASE WITH VEHICLE TRAVEL SIMULATION MEANS FOR MOUNTING A VEHICLE INFANT SEAT

(76) Inventors: Christopher Manenti, 11771 Royal Palm Blvd., No. 101, Coral Springs, FL (US) 33065; Kevin M. Linn, 10122 NW. 2nd St., Coral Springs, FL (US) 33071

( * ) Notice: Subject to any disclaimer, the term of this patent is extended or adjusted under 35 U.S.C. 154(b) by 102 days.

(21) Appl. No.: 11/102,213

(22) Filed: Apr. 7, 2005

(51) Int. Cl.
*A47C 7/72* (2006.01)
*A63G 9/10* (2006.01)

(52) U.S. Cl. ..... 297/217.3; 297/181; 297/217.4; 297/256.16; 601/90; 446/7

(58) Field of Classification Search ..... 297/217.3, 297/217.4, 181, 256.16; 601/90, 91, 98, 601/86; 446/3, 7
See application file for complete search history.

(56) References Cited

U.S. PATENT DOCUMENTS 5,775,771 A * 7/1998 La Cour et al. ..... 297/217.4
5,860,698 A * 1/1999 Asenstorfer et al. ... 297/217.4 X
6,378,940 B1 * 4/2002 Longoria et al. ..... 297/217.3
6,431,646 B1 * 8/2002 Longoria ..... 297/217.3
7,039,207 B1 * 5/2006 Elrod et al. ..... 297/217.4 X

* cited by examiner

*Primary Examiner*—Anthony D Barfield
(74) *Attorney, Agent, or Firm*—Frank L. Kubler

(57) ABSTRACT

An infant seat base removably retaining an infant seat having a seat forward end which a seated infant faces and for simulating the sensations of travel in a road vehicle includes at least one vibration mechanism transmitting vibration into the seat for simulating vehicle vibration from tire movement over road surface irregularities; a recorded sound storing and playing mechanism for playing the sound of a moving road vehicle to an infant in the seat; a view simulation back drop structure having the appearance of a road vehicle seat backrest secured to the base at the seat forward end; and a base circuit including a power source delivering power through the circuit to the at least one vibration mechanism and to the recorded sound storing and playing mechanism.

3 Claims, 3 Drawing Sheets

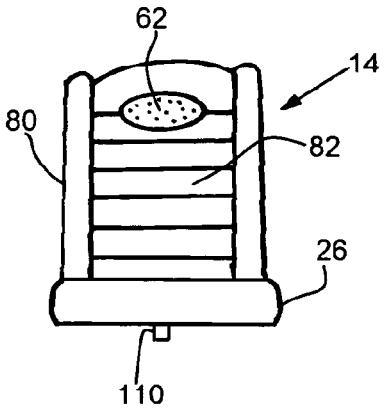
FIG.4
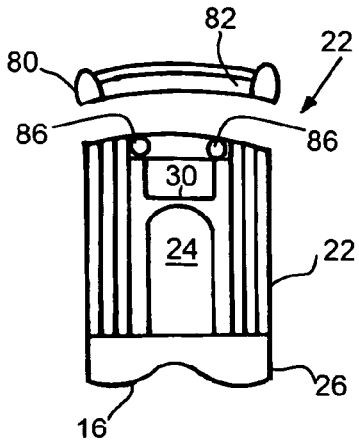
FIG.5
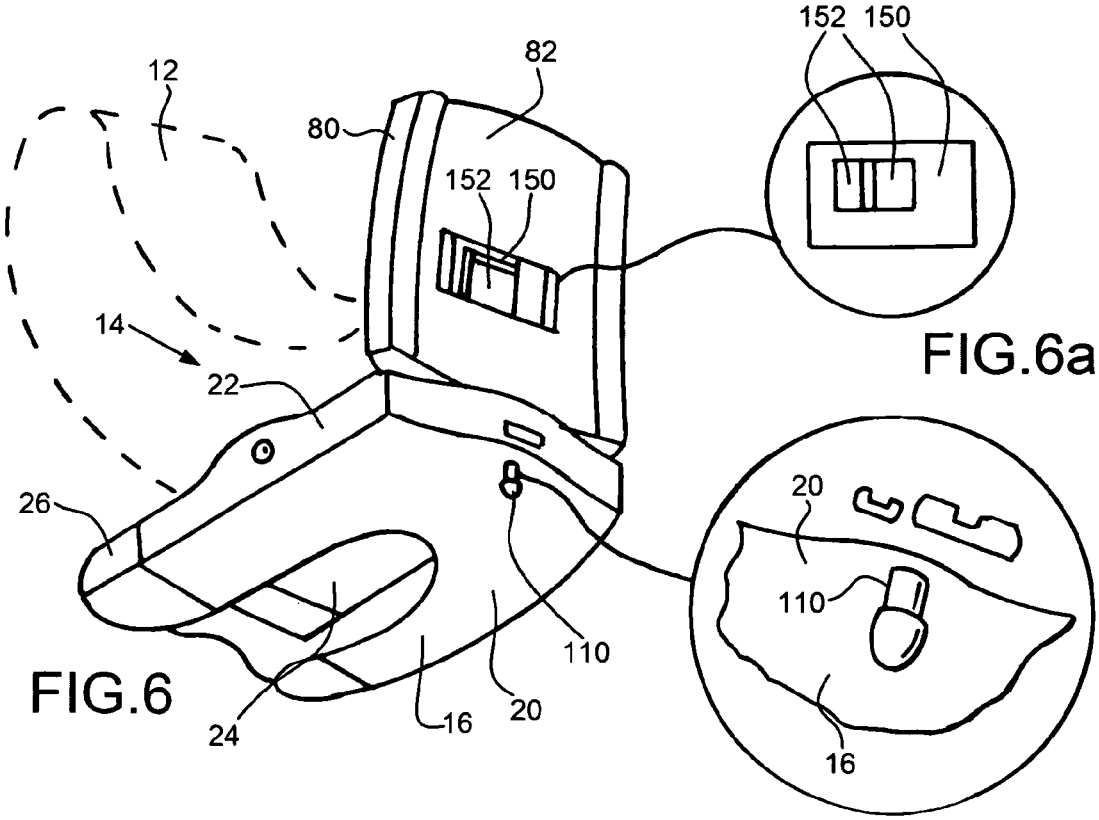
FIG.6
FIG.6a
FIG.6b

INFANT SEAT BASE WITH VEHICLE TRAVEL SIMULATION MEANS FOR MOUNTING A VEHICLE INFANT SEAT

BACKGROUND OF THE INVENTION

1. Field of the Invention

The present invention relates generally to the field of infant seats for mounting onto a road vehicle seat facing the vehicle seat backrest. More specifically the present invention relates to an infant seat base and seat assembly which includes simulation mechanisms simulating the sensations of travel in a road vehicle such as an automobile, a sport utility vehicle or a truck while the infant base and seat assembly is in a location outside a vehicle to create the rest and sleep inducing feelings of road travel, and preferably additionally includes an arched bottom surface and a powered rocking mechanism for rocking the infant base and seat assembly on the arched base bottom surface and against a support surface on which the base and seat assembly rests. The travel simulation mechanisms preferably include at least one vibration mechanism for simulating vehicle vibration from tire movement over road surface irregularities, recorded sound storing and playing means for broadcasting the sound of a moving road vehicle to an infant in the seat, and a view simulation back drop structure having the appearance of a road vehicle seat backrest, which an infant in a road vehicle infant seat normally faces.

The base and seat assembly includes an assembly upper portion in the form of a standard infant seat and a separate assembly lower portion in the form of an infant seat base incorporating the various simulation mechanisms and which removably receives and retains the infant seat. Alternatively the base and seat assembly jointly incorporates the simulation and rocking mechanisms.

The powered rocking means preferably takes the form of an extensible foot structure protruding downwardly from one elevated end of the arched bottom surface through a foot port in the seat base shell, and a foot reciprocating mechanism within the base. The base contains a base circuit including a battery or outlet cord power source delivering power through the circuit to the vibration mechanisms, the recorded sound storing and playing means and the rocking mechanism. Where a sound chip with recording capability is provided, the control panel includes a recording activation switch and a recorded sound playing switch, as well as a microphone.

2. Description of the Prior Art

There have long been infant seats fitting into seat bases secured to seats in motor vehicles for safely retaining infants while the motor vehicle is moving. The motion of the motor vehicle over a road surface creates certain sounds and sensations which are relaxing and can cause an infant to sleep. A problem has been that once the infant seat and base are removed from the motor vehicle, the relaxing sensations of road travel are gone.

It is thus an object of the present invention to provide a road vehicle infant seat base which simulates the sound, road surface rolling vibration and seat view experienced by an infant during actual road travel, to relax, entertain and induce sleep.

It is another object of the present invention to provide such an infant seat base including an infant seat which can fit into the seat base of a standard infant seat.

It is finally an object of the present invention to provide such an infant seat base which is safe, durable and relatively

SUMMARY OF THE INVENTION

The present invention accomplishes the above-stated objectives, as well as others, as may be determined by a fair reading and interpretation of the entire specification.

An infant seat base removably retaining an infant seat having a seat forward end which a seated infant faces and for simulating the sensations of travel in a road vehicle, including at least one of: a vibration mechanism transmitting vibration into the seat for simulating vehicle vibration from tire movement over road surface irregularities; a recorded sound storing and playing mechanism for playing the sound of a moving road vehicle to an infant in the seat; a view simulation back drop structure having the appearance of a road vehicle seat backrest secured to the base at the seat forward end; and a base circuit including a power source delivering power through the circuit to the at least one vibration mechanism and to the recorded sound storing and playing mechanism.

The infant seat base preferably additionally includes an arched base bottom surface and a powered rocking mechanism connected to a power source for rocking the base and infant seat on the arched base bottom surface and against a support surface on which the base rests.

A base and seat for simulating the sensations of travel in a road vehicle, including an infant seat having a seat forward end; and an infant seat base removably retaining the infant seat and including at least one vibration mechanism transmitting vibration into the seat for simulating vehicle vibration from tire movement over road surface irregularities; a recorded sound storing and playing mechanism for playing the sound of a moving road vehicle to an infant in the seat; a view simulation back drop structure having the appearance of a road vehicle seat backrest secured to the base at the seat forward end; and a base circuit including a power source delivering power through the circuit to the at least one vibration mechanism and to the recorded sound storing and playing mechanism.

The infant seat base preferably includes an arched base bottom surface and a powered rocking mechanism connected to a power source for rocking the infant base and seat assembly on the arched base bottom surface and against a support surface on which the base rests. The base preferably additionally includes a molded plastic base shell configured to include a substantially rectangular base frame with a frame central opening. The base frame preferably includes a forwardly extensible forward frame segment. The seat base preferably additionally includes an upwardly protruding seat abutment panel abutting and supporting the weight of the infant seat and of a seated infant.

The base preferably additionally includes upwardly opening mounting post openings and the back drop structure preferably includes a removable seat back simulation panel having downwardly protruding mounting posts which fit into the mounting post openings in the infant seat base. The base and seat assembly preferably additionally includes a toy suspending bridge having downwardly protruding mounting posts for mounting in the mounting post openings in place of the mounting posts of the back drop structure.

The at least one vibration mechanism preferably is contained within the abutment panel to transmit vibration upwardly through the abutment panel and into the infant seat. The recorded sound storing and playing mechanism preferably includes a speaker mounted in the back drop structure and oriented toward the infant seat mounted in the base.

The base shell preferably includes a foot port and the powered rocking mechanism preferably includes an extensible foot structure protruding downwardly from one elevated end of the arched bottom surface through the foot port in the base shell, and a foot reciprocating mechanism within the base shell for cyclically driving the foot structure downwardly against a support surface to rock the base and seat assembly. The base and seat assembly preferably additionally includes a control panel with button operated switches for controlling the simulation mechanisms. The recorded sound storing and playing mechanism preferably additionally includes a sound chip having recording capability and a microphone connected to the sound chip for recording sound in the sound chip.

A base and seat assembly for simulating the sensations of travel in a road vehicle, including at least one vibration mechanism transmitting vibration through the seat for simulating vehicle vibration from tire movement over road surface irregularities; and a recorded sound storing and playing mechanism for playing the sound of a moving road vehicle. The base and seat assembly preferably additionally includes a view simulation back drop structure having the appearance of a road vehicle seat backrest.

BRIEF DESCRIPTION OF THE DRAWINGS

Various other objects, advantages, and features of the invention will become apparent to those skilled in the art from the following discussion taken in conjunction with the following drawings, in which:

FIG. 4 is a front plan view of the base.

FIG. 5 is a top plan view of the base.

FIG. 6 is a perspective bottom and rearward view of the base of FIG. 1.

FIG. 6*a* is a close-up view of the control panel on the rear face of the backdrop structure.

FIG. 6*b* is a broken away close-up view of the arched base bottom surface and of the extensible foot structure.

DETAILED DESCRIPTION OF THE PREFERRED EMBODIMENTS

Figure 1:
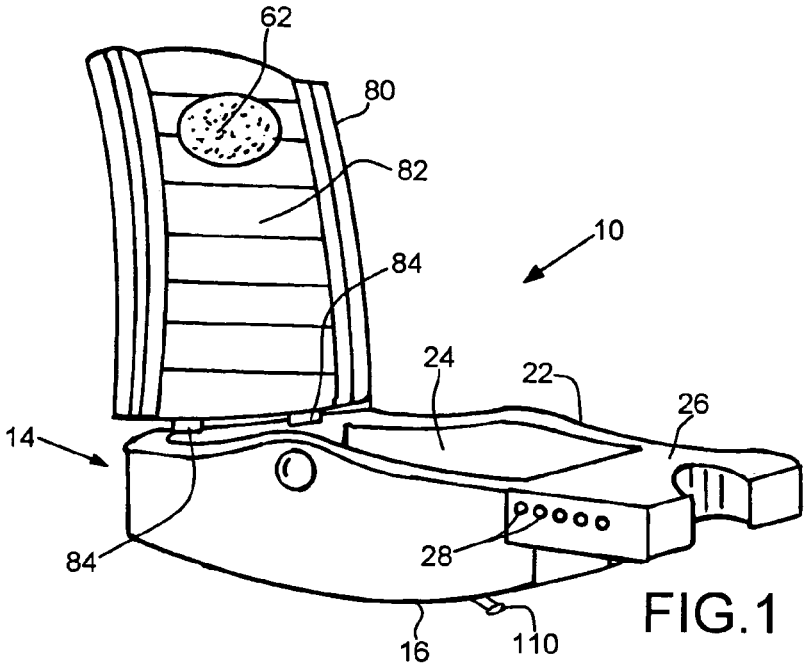
FIG. 1 is a perspective side view of the preferred embodiment of the base.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
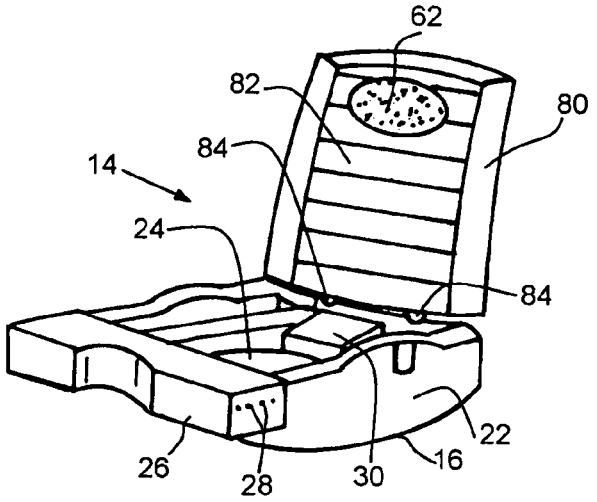
FIG. 2 is a perspective front view of the embodiment of FIG. 1.
Figure 3:
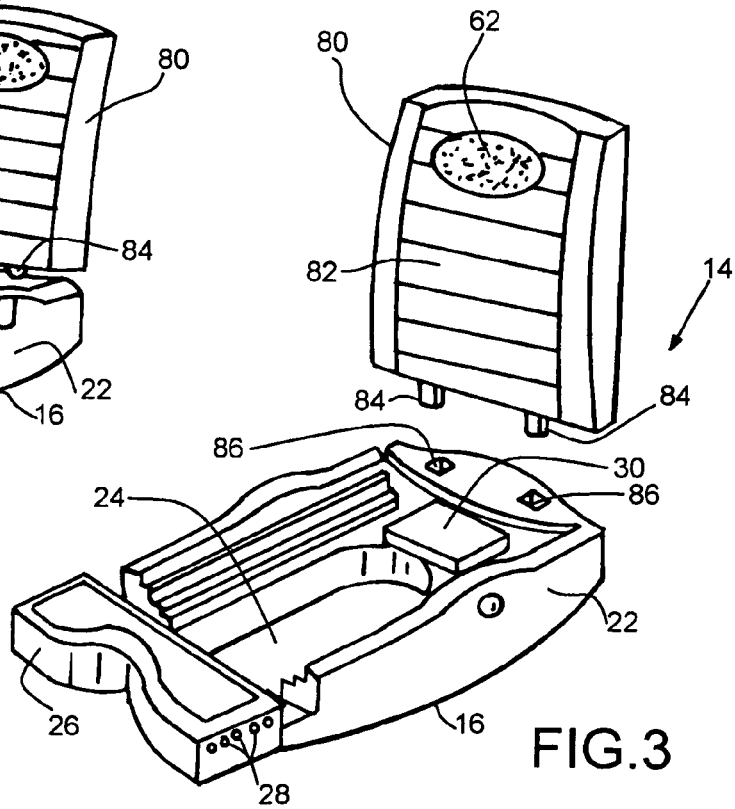
FIG. 3 is an exploded view of the base of FIG. 1.
Figure 7:
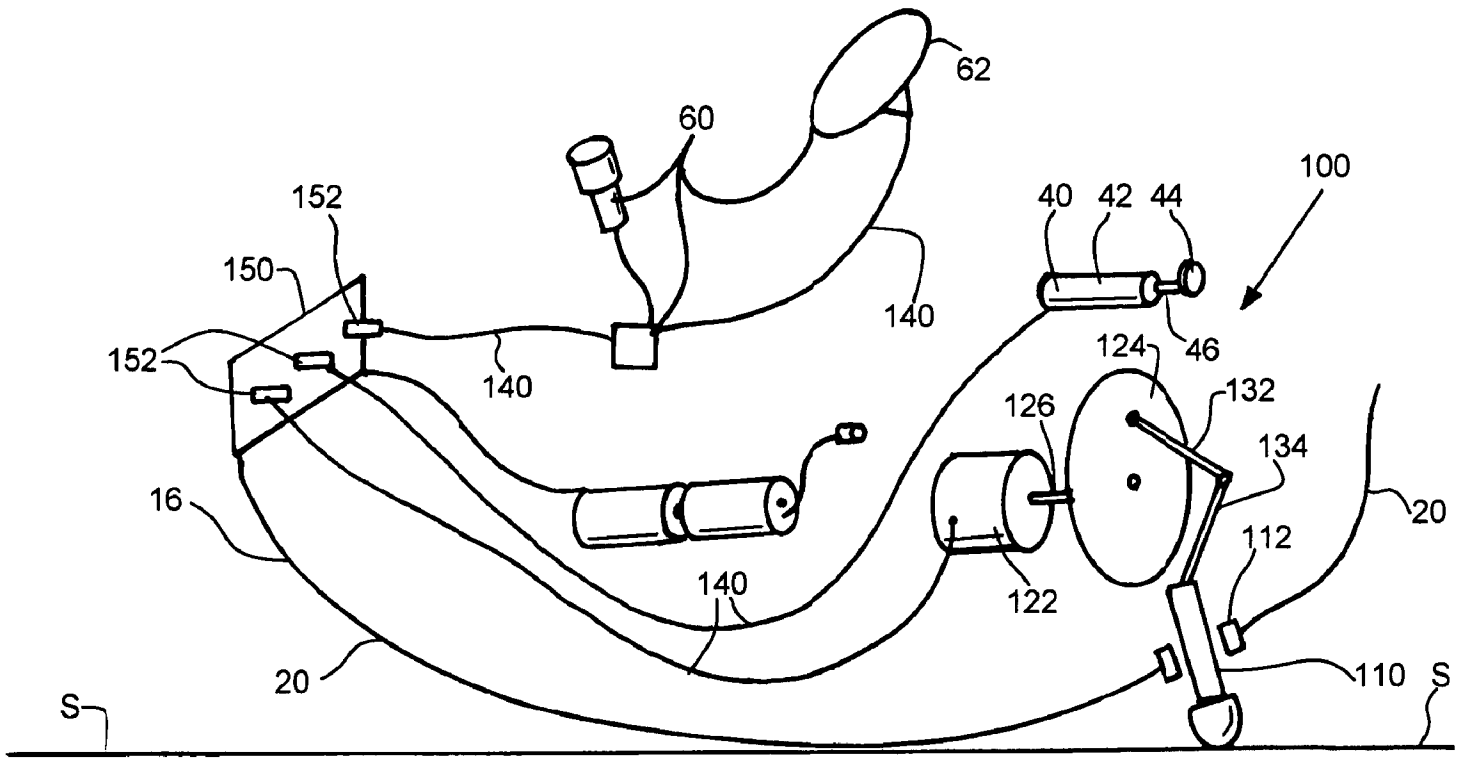
FIG. 7 is a schematic cross-sectional side view of the base, showing details of the powered rocking mechanism and base circuit.

Referring to FIGS. 1-7, an infant seat base and seat assembly 10 is disclosed which includes simulation mechanisms simulating the sensations of travel in a road vehicle while the infant base and seat assembly 10 is in a location outside a vehicle to create the rest and sleep inducing feelings of road travel, and preferably additionally includes an arched base bottom surface 16 and a powered rocking mechanism 100 for rocking the infant base and seat assembly 10 on the arched base bottom surface and against a support surface S on which the base and seat assembly 10 rests. The travel simulation mechanisms preferably include at least one vibration mechanism 40 for simulating vehicle vibration from tire movement over road surface irregularities, recorded sound storing and playing means 60 for broadcasting the sound of a moving road vehicle to an infant in the seat, and a view simulation back drop structure 80 having the appearance of a road vehicle seat backrest, which an infant in a road vehicle child seat normally faces.

The base and seat assembly 10 includes an assembly upper portion in the form of a standard infant seat 12 and a separate assembly lower portion in the form of an infant seat base 14 incorporating the various simulation mechanisms and which removably receives and retains the infant seat 12. The arched bottom surface is the seat base bottom surface 16.

The seat base 14 preferably includes a molded plastic seat shell 20 configured to include a substantially rectangular base frame 22 with a frame open center 24 and a separable and forwardly extensible forward frame segment 26 having extension adjustment buttons 28. Protruding forwardly from the rearward end of the frame 22 into the frame open center 24 is an upwardly protruding seat abutment panel 30 for abutting, and supporting the weight of a seat 12 and infant.

The back drop structure 80 preferably takes the form of a removable seat back simulation panel 82 having downwardly protruding mounting posts 84 which fit into upwardly opening mounting post openings 86 in opposing frame 22 side segments. The seat back simulation panel 82 preferably is replaceable with a toy suspending bridge 90 having an inverted U-shape.

Each of the one or more vibration mechanisms 40 preferably is an electric motor 42 having a weight 44 mounted off-center to the motor drive shaft 46, and have been known and used previously in other areas of art. These eccentric weight vibration mechanisms 40 are contained within the abutment panel 30 to transmit vibration upwardly through the abutment panel 30 and into the seat 12. The recorded sound storing and playing means 60 includes a speaker 62 preferably mounted in the back drop structure 80 upper end, and directed back toward a seat 12 mounted in the base 14. For this speaker 62 position, the speaker preferably has its own separate power source 52 in the form of one or more batteries, and these batteries as well as the remainder of the sound storing and playing means 60 in the form of a chip 54, either RAM or ROM, are contained within the back drop structure 80.

The powered rocking mechanism 100 preferably takes the form of an extensible foot structure 110 protruding downwardly from one elevated end of the arched base bottom surface 16 through a foot port 112 in the seat shell 20, and a foot reciprocating mechanism 120 within the seat shell 20 which cyclically drives the foot structure 110 downwardly against a seat support surface S to the base 14 and rock seat 12 in a first direction beyond its equilibrium rest position, and then retracts the foot structure 110 so that the stored potential energy of the tilted base 14 and seat 12 carries the base 14 and seat back to and beyond its equilibrium rest position to rock in a second direction, in a repeating sequence. The reciprocating mechanism 120 preferably includes an electric motor 122 having a wheel 124 mounted to its drive shaft 126 and a first foot structure linkage 132 mounted pivotally and off-center to the wheel 124 and extending perpendicular to the motor drive shaft 126 and pivotally mounted to a second foot structure linkage 134 pivotally mounted to the foot structure 110. Alternatively, the powered rocking mechanism 100 includes a weight and a weight shifting mechanism for shifting the weight within the seat shell 20 so that the momentum of the shifting weight causes the base 14 to rock back and forth on its arched base bottom surface. The rocking preferably is front to back, and alternatively from side to side if the base bottom surface 16 has a lateral arch shape, or both if the base bottom surface 16 has a double arch or dome shape, as desired.

The base contains a base circuit 140 including a battery 142 or outlet cord power source delivering power through the circuit 140 to the vibration mechanisms 40, the recorded sound storing and playing means 60 and the rocking mechanism 100. A control panel 150 including button operated switches 152 for controlling the simulation mechanisms is provided on the forward surface of the base shell 20 immediately above the arched base bottom surface 16 forward end. The switches 152 include a rocking control switch with a rocking OFF position and several rocking ON positions of incremental rocking magnitudes. There is also a switch for adjusting speaker 62 volume. Where a sound chip 54 with recording capability is provided, the control panel switches 152 includes a recording activation switch and a recorded sound playing switch, as well as a microphone 56.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A base and seat removably for simulating the sensations of travel in a road vehicle, comprising:

an infant seat having a seat forward end;

and an infant seat base removably retaining said infant seat and comprising at least one vibration mechanism transmitting vibration into said seat for simulating vehicle vibration from tire movement over road surface irregularities; recorded sound storing and playing means for playing the sound of a moving road vehicle to an infant in the seat; a view simulation back drop structure having the appearance of a road vehicle seat backrest secured to said base at the seat forward end; and a base circuit comprising a power source delivering power through the circuit to said at least one vibration mechanism and to said recorded sound storing and playing means;

wherein said base additionally comprises upwardly opening mounting post openings and wherein said back drop structure comprises a removable seat back simulation panel having downwardly protruding mounting posts which fit into said mounting post openings in said infant seat base.

2. The base and seat assembly of claim 1, additionally comprising a toy suspending bridge having downwardly protruding mounting posts for mounting in said mounting post openings in place of said mounting posts of said back drop structure.

3. A base and seat removably for simulating the sensations of travel in a road vehicle, comprising:

an infant seat having a seat forward end and comprising an arched base bottom surface and a powered rocking mechanism connected to a power source for rocking the infant base and seat assembly on the arched base bottom surface and against a support surface on which the base rests;

and an infant seat base removably retaining said infant seat and comprising at least one vibration mechanism transmitting vibration into said seat for simulating vehicle vibration from tire movement over road surface irregularities; recorded sound storing and playing means for playing the sound of a moving road vehicle to an infant in the seat; a view simulation back drop structure having the appearance of a road vehicle seat backrest secured to said base at the seat forward end; and a base circuit comprising a power source delivering power through the circuit to said at least one vibration mechanism and to said recorded sound storing and playing means;

wherein said base shell comprises a foot port and wherein said powered rocking means comprises an extensible foot structure protruding downwardly from one elevated end of said arched bottom surface through said foot port in said base shell, and a foot reciprocating mechanism within said base shell for cyclically driving said foot structure downwardly against a support surface to rock said base and seat assembly.

* * * * *